United States Patent [19]

Artzt et al.

[11] 4,078,231

[45] Mar. 7, 1978

[54] METHOD AND APPARATUS FOR MONITORING THE FLAWS IN SPUN YARN PRODUCED ON OPEN END ROTOR SPINNING MACHINES

[75] Inventors: Peter Artzt, Pfullingen; Herbert Bauer, Reutlingen; Gerhard Egbers, Eningen; Sohrab Tabibi, Pfullingen, all of Germany

[73] Assignee: Schubert & Salzer, Ingolstadt, Germany

[21] Appl. No.: 694,806

[22] Filed: Jun. 10, 1976

[30] Foreign Application Priority Data

Jun. 25, 1975 Germany ..... 2528290

[51] Int. Cl.[2] ..... G08B 21/00

[52] U.S. Cl. ..... 340/259; 73/160; 226/44; 242/75.44

[58] Field of Search ..... 340/259; 200/61.13, 200/61.14, 61.18; 66/162, 164, 161, 163; 226/10, 11, 44, 45; 242/184, 75.44; 28/64; 57/81; 324/34 TK; 73/160; 235/151.3

[56] References Cited

U.S. PATENT DOCUMENTS

| | | | |
|---|---|---|---|
| 2,983,464 | 5/1961 | Fuller | 242/75.44 |
| 3,458,151 | 7/1969 | Eastcott | 242/75.44 |
| 3,497,154 | 2/1970 | Lasarev et al. | 242/75.44 |
| 3,594,755 | 7/1971 | Emmasingel | 340/259 |
| 3,667,664 | 6/1972 | Schroeder | 226/44 |
| 3,725,889 | 4/1973 | Glosek | 340/259 |
| 3,731,069 | 5/1973 | Goto et al. | 340/259 |
| 3,912,145 | 10/1975 | Meihofer | 226/44 |
| 4,007,457 | 2/1977 | Aeppli | 340/259 |

*Primary Examiner*—John W. Caldwell, Sr.
*Assistant Examiner*—James J. Groody
*Attorney, Agent, or Firm*—Bailey, Dority & Flint

[57] ABSTRACT

A method and apparatus for monitoring the production of spun yarn in an open end rotor spinning machine. The spun yarn is withdrawn from the open end rotor spinning machine at a constant rate of speed. As a result of changes in mass of the yarn created by flaws therein, the centrifugal force within the rotor varies causing the tension in the yarn to vary accordingly. As the yarn is withdrawn from the rotor, it passes around a spring loaded arm which is displaced according to the centrifugal force applied to the yarn. The spring loaded arm is operately connected to a balance bridge circuit which generates an output signal corresponding to the displacement thereof. The output signal from the balance circuit is then fed to an integrator which integrates the signal to produce a slowly varying integrated reference signal. The output signal from the bridge circuit is also converted into a short time or instantaneous signal that is compared with the integrated signal for producing an out of tolerance signal if and when flaws occur in the yarn. The system produces an out of tolerance signal resulting from thin spots, thick or heavy spots, and/or breaks within the yarn.

11 Claims, 3 Drawing Figures

Fig.1
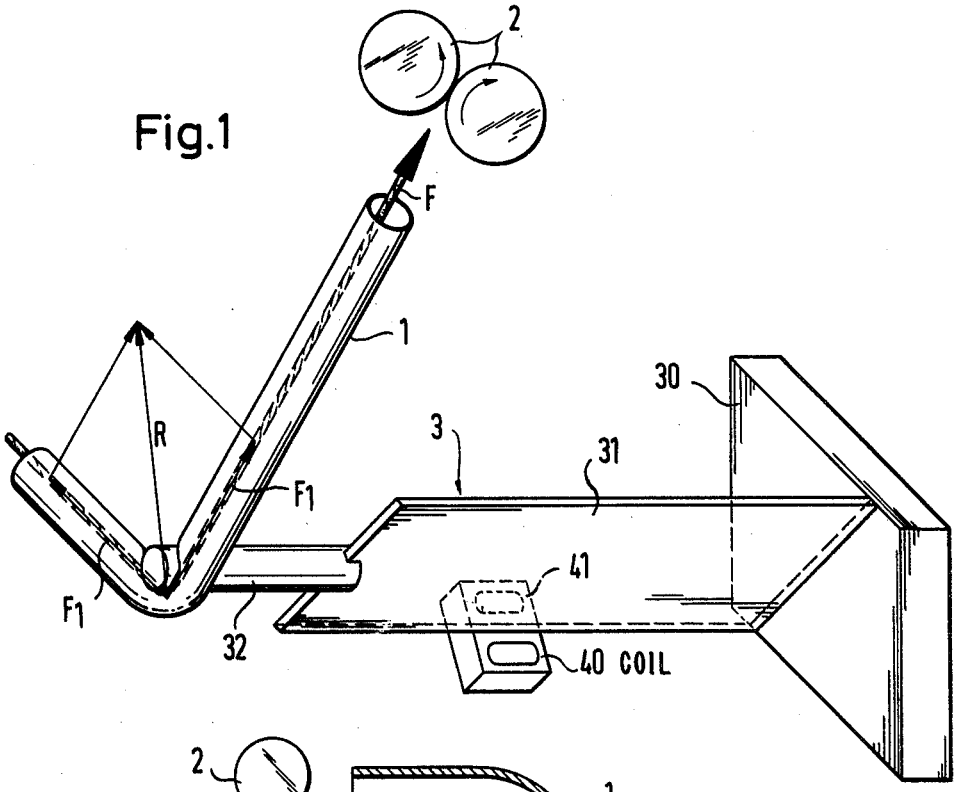
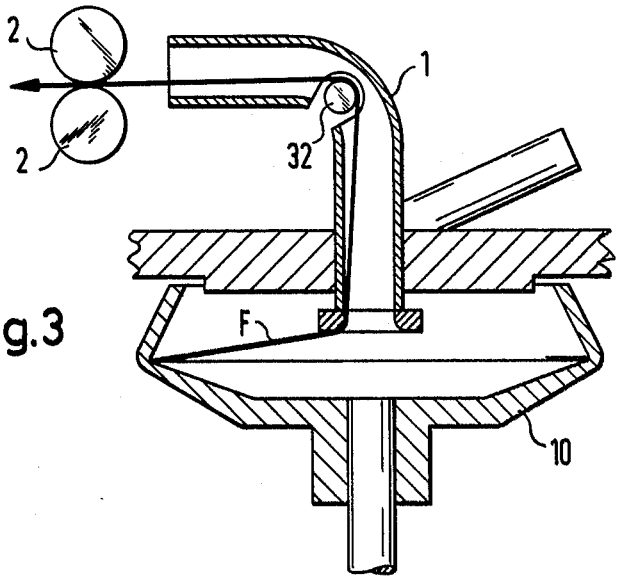
Fig.3

METHOD AND APPARATUS FOR MONITORING THE FLAWS IN SPUN YARN PRODUCED ON OPEN END ROTOR SPINNING MACHINES

BACKGROUND OF THE INVENTION

The present invention relates to a monitoring device and more particularly to a device which senses flaws in yarn being manufactured in an open end rotor spinning machine as a result of changes in centrifugal force being applied to the yarn.

For the purposes of economical production in the yarn processing textile industry, yarn which is turned out by spinning machines is usually wound on pirns. This requires that the yarn be rewound on spool machines for making up large format spools. Normally, the yarn is cleaned during this rewinding process. The thread is cleaned in this process by the removal of thick bulky points, either by means of slit cleaning or by means of electronic thread cleaners which, for example, are functionally connected to a thread cutting device (German Patent Laid Open to Inspection No. 2,132,137). Associated with the slit cleaning device is a thread sensor that triggers the stoppage of the spool responsive to the breaking of the thread.

The yarns which are spun according to the open end spinning method are already wound up into cross spools at their spinning point and a respooling merely for the purpose of threading cleaning is uneconomical. It, therefore, has already been proposed to transfer the arrangement of slit cleaner and thread sensor, which are known from spool cleaning machines, to an open end spinning device (German Patent Published for Opposition, No. 1,814,033).

Slit cleaners, however, influence the thread quality unfavorably. The thread is roughed up by the edges of the cleaner and thus gets a rather hairy appearance. Besides, there is a danger that the thick places, which are only a little larger than the width of the slit, will pass through the cleaner without causing the thread to break off. Preference is, therefore, given to the use of electronic yarn cleaners which work on a capacitor or optical basis. The measurement value detectors of this type of device are expensive. They are furthermore exposed to environmental factors and operating conditions which impair their response sensitivity. Another disadvantage exists in the fact that these systems are influenced by the passage speed of the thread so that it cannot fall below a certain speed.

SUMMARY OF THE INVENTION

It is the purpose of this invention to create a device which will facilitate the precise monitoring of a thread, spun on an open end rotor spinning machine in terms of detecting thick and thin points as well as thread breaks in a simple manner avoiding the disadvantages of the known devices.

This problem is solved by using the centrifugal force which acts on the yarn being produced in the rotor of the open end spinning machine. Variances in the yarn weight or mass in the rotor causes the centrifugal force to vary accordingly and this force is used to generate a corresponding electrical signal. When this electrical signal exceeds a threshold value, a switching signal is produced that can be utilized for stopping the open end spinning machine. Checking the yarn for thick and thin points is facilitated by the fact that an upper and lower threshold value is utilized. During the monitoring of the thread being produced, electrical signals are produced which are proportional to the particular weight of the thread. This electrical signal is converted into a slowly varying signal or an integrated signal which acts as a reference voltage. It is also converted into a short time or instantaneous signal corresponding to the weight at a particular instance of the yarn. This eliminates the adjustment of the device for different weight yarns as well as for different rotor rpm's.

The device includes a thread sensor exerting pressure on the thread and a switching means which can be activated by the thread sensor. The thread sensor incorporates a normal (Eigen) frequency of its own which is smaller than the lowest revolving frequency of the spinning rotor during the spinning process and, as a function of the higher or lower thread tension acting upon it, the sensor is deflected out of its normal or middle position into two mutually opposite directions running essentially lateral to the axis of the thread and if this deflection exceeds certain predetermined values an out of tolerance signal is produced.

Higher frequency thread peaks, which are due to the spinning methods itself, are thus excluded from being detected by the thread sensor. To get a deflection proportional to the thread tension, the thread sensor follows the Hooke's Law in terms of its deflection sector. In this way, we can make sure that the sensitivity of the monitoring device will be independent of the level position of the measurement magnitude so that there can be the same measurement accuracy in every sector.

In one particular embodiment of the invention, the thread sensor is designed as a bending spring which is clamped at one end. The measurement value detector includes two parallel spaced coils which have an electric field that is interrupted by the bending spring. It is to be understood that instead of using spaced coils, field plates may be utilized. It is advantageous to utilize after the measurement value detector or sensing device an integrator, a voltage divider, a comparator, as well as a signal transmitter. The voltage divider is adjustable so as to vary the degree of cleaning that is desired.

Accordingly, it is an important object of the present invention to provide a monitoring device which monitors the flaws in yarn being produced on an open end spinning machine.

Still another important object of the present invention is to provide a monitoring device which senses thick and thin places in yarn being produced and generates an out of tolerance signal when the flaws exceed certain predetermined levels.

Still another important object of the present invention is to provide a simple and efficient yarn monitoring operation wherein it can be utilized for different size yarns without any modifications or adjustments thereto.

Still another important object of the present invention is to provide a very simple and accurate monitoring device which monitors the mass of yarn being produced in open end spinning rotor machines by monitoring the variations in centrifugal force being produced on the yarn in the rotating rotor.

These and other objects and advantages of the invention will become apparent upon reference to the following specification, attendant claims and drawings.

BRIEF DESCRIPTION OF THE DRAWINGS

FIG. 1 is a perspective view of a monitoring device constructed in accordance with the present invention, arranged at the withdrawal part of an open end spinning device.

FIG. 3 is a sectional view illustrating a spinning rotor of an open end spinning machine and, in particular, the thread withdrawal part.

DESCRIPTION OF A PREFERRED EMBODIMENT

Figure 2:
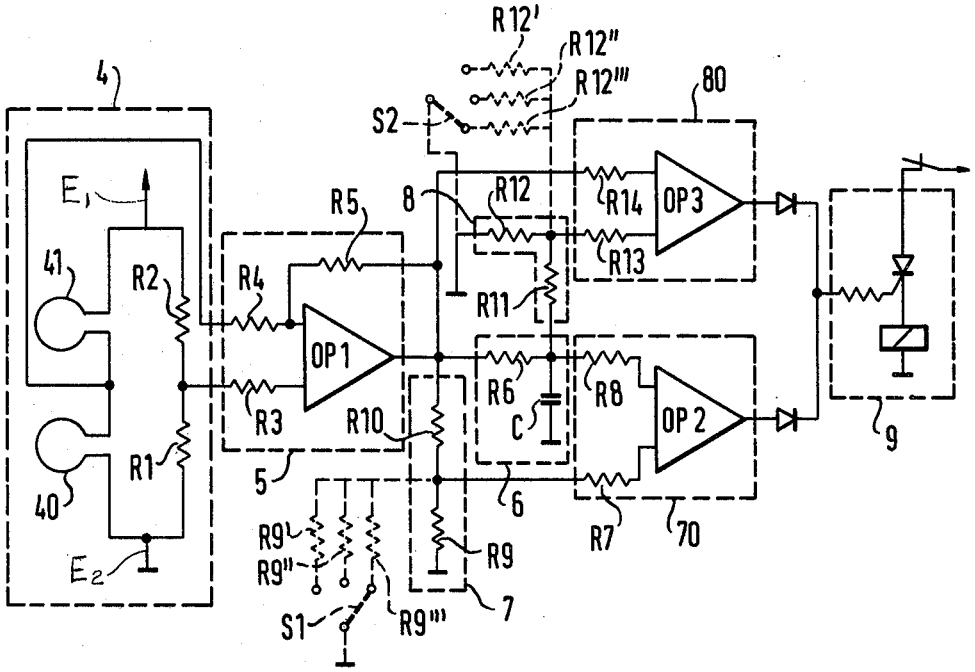
FIG. 2 is a schematic diagram of the electrical portion of the monitoring device.

The thread F which is produced in the rotor 10 (FIG. 3) of an open end spinning machine, is conducted through a withdrawal pipe 1 and is withdrawn by a pair of rollers 2. Withdrawal pipe 1 is bent in the known manner in order to deflect the thread F during its movement in the direction toward the pair of rollers 2. In rotor 10, there acts upon thread F a centrifugal force from which results a thread tension $F_1$ (FIG. 1) between rotor 10 and the clamping point of the pair of rollers 2. This tension can be computed from $F_1 = m \cdot r \cdot a^2 \cdot c$, whereby the constant, considering deflection, is $c = e\mu^{dyn \cdot \alpha}$. It follows from this that a change in the thread mass or weight $m$ as a result of a thick or thin point present in thread F, leads to a rise or drop in the thread tension $F_1$ which is proportional to the change in the mass. According to the invention, the centrifugal force, acting upon thread F, is used to measure the thread weight by means of the thread tension $F_1$, as will be described in greater detail below.

Thread F is checked for thick or thin points as well as thread ruptures particularly in the area of the deflection point of thread F in the withdrawal pipe 1. The wall of the withdrawal pipe 1 is interrupted at this point so that the thread F is exposed. For monitoring we use a thread sensor whose natural (Eigen) frequency is smaller than the lowest revolving frequency that the rotor 10 has during the spinning process. One particular thread sensor 3 consists of a bending spring 31, which is clamped at one end in a bearing block 30, and has a cylindrical arm 32 attached to its free end that is constructed of any suitable low friction material. The thread sensor follows Hooke's Law with regard to its deflection sector. A thread sensor thus constructed excludes the possibility that thread tension peaks, due to the process itself, are detected, such as occur, for example, during rotor spinning when the thread moves on through the feed-in point. Bending spring 31 is prestressed so that the arm 32, which extends laterally to the thread axis and which simultaneously takes care of the deflection of thread F, constantly exerts a pressure on thread F. Working against this pressure, there is a resultant force R which is equivalent to the thread tension forces $F_1$ effective in two different directions and which are applied at arm 32. The prestressing of the bending spring 31 is so dimensioned that when a flawless thread F passes over the arm 32, the resultant force R and the pressure of the spring 32 upon the thread F will cancel each other out. In this case, the thread sensor is in a middle position with respect to two coils 40 and 41 which are arranged on both sides of the bending spring 31 and which are a part of the balanced bridge circuit 4 (FIG. 2). It is to be understood that the middle position does not necessarily need to correspond to the geometric center.

If a thick point is present on thread F, then the thread tension increases in proportion to the existing, greater thread weight and thus there is also an increase in the resultant force R which is equivalent to it and which is applied at arm 32. It forces the thread sensor 3 into a corresponding deflection from its middle position with respect to coils 40 and 41 whereby the bending spring causes the inductances of the coils 40 and 41 to correspondingly be varied according to the deflection of spring 31 determined by the force R. It is to be understood that an exciting voltage is applied between terminal E1 and E2 so that as the inductances of the coils 40 and 41 are varied, an electrical signal is produced on the output of the detector 4 which corresponds to the displacement of the spring 31.

The bridge circuit consists of coils 40 and 41 and resistances R1 and R2. The output signal from the bridge circuit 4 is thereafter converted into a slow varying signal or an integrated signal by an integrator 6 and into a instantaneous or short time signal which corresponds to the desired degree of cleaning. At first, the output signal is amplified by amplifier 5 which is made up of operational amplifier OP1 and resistors R3, R4, and R5. From the output of the amplifier 5, the signal passes through integrator 6, consisting of resistance R6 and condensor C producing an integrated signal that corresponds to the mean value of the thread weight and only follows long term changes in the mass of the yarn. Normally, for best operation, the mean value is taken over a period of about 1 minute so that tension peaks, for example, during the initial spinning start procedure, which are due to the process itself will not exert any influence thereon. The mean value signal which is sometimes referred to hereafter as a reference signal is created by the integrator 6 and is fed to the first input of a comparator 70 consisting of an operational amplifier OP2 and resistances R7 and R8. At the same time, the instantaneous or short time signals leaving amplifier 5 is attentuated in accordance with the degree of cleaning desired, for example, in voltage divider 7, which consists of resistances R9 and R10. It is then immediately supplied to the second input of comparator 70.

When the instantaneous or short-time signal which is attentuated in the voltage divider 7 and caused by a thick point in thread F exceeds the mean value signal or reference signal formed in the integrator 6, such causes the comparator 70 to produce an out of tolerance signal that is fed to a signal transmitter 9. This signal can be used as a switching function, for example, to shut off the fiber supply or to cut off thread F. As illustrated in FIG. 2 of the drawing, the signal is being fed to a silicon control rectifier forming part of the transmitter 9 for producing the switching function.

If the thread on the other hand reveals a thin point, then the thread tension decreases in proportion to the now existing lower thread weight and there is a corresponding decrease in the resulting force R which is applied to arm 32. The deflection of the thread sensor 3 from its middle position due to a prestressing of the bending spring 31 takes place in the direction towards coil 41 of the bridge 4. This is in a direction opposite to the direction of movement as when a thick point occurs in the yarn.

The deflection of the thread sensor 3 from its middle position once again generates a signal which corresponds to the thread weight and which is preferably proportional to it. As described above with regard to the thick point determination, the signal is converted into an integrated signal and an instantaneous or short time signal corresponding to the degree of cleaning desired. Referring to the details of the schematic diagram, the signal coming from the bridge circuit is amplified by amplifier 5 and supplied to the integrator 6 which produces the integrated signal which corresponds to the mean value of the fiber weight. The integrated signal formed in integrator 6 is attentuated in voltage divider 8 by resistors R11 and R12 in a fixed ratio to the signal from amplifier 5 and serves as a threshold for recognizing thin points. Thus, a lower threshold value is produced here in contrast to the thick point determination as previously described wherein an upper threshold value was produced. The attentuator signal is supplied to the first input of a comparator 80 which consists of operational amplifier OP3 and resistances R13 and R14. At the same time, the instantaneous signal, coming out of amplifier 5, goes to the second amplifier of comparator 80. If the signal coming out of amplifier 5 falls below the attentuating sliding mean value in voltage divider 8 then the comparator 80 gives off an impulse to the signal transmitter 9 which as described above can be used as a switching function. The same process takes place when a thread rupture occurs.

To select the desired degree of cleaning, the magnitude of the degree of attenuation in voltage dividers 7 and 8 can be varied. This can be done, for example, by means of the parallel connection of resistance magnitudes in a central control unit, such as indicated by resistances R9', R9'', R9''' with switch S1 and resistances R12', R12'', and R12''' with switch S2.

As can be seen from the above, a ratio is formed between the instantaneous signal and the response threshold values which is derived from the means value. Compared to the situation wherein the threshold values are fixed, this offers the advantage that this ratio formation can be used without switching around for different yarn numbers, feed speeds, and rotor rpm.

Other solutions are possible for the design of the switching means and the thread sensor. For example, instead of utilizing coils 40 and 41, field plates or Hall generators can also be utilized. In place of a bending spring clamped on one side only, other types of thread sensors which follows Hooke's Law with regard to its deflection section could be utilized.

While a preferred embodiment of the invention has been described using specific terms, such description is for illustrative purposes only, and it is to be understood that changes and variations may be made without departing from the spirit or scope of the following claims.

What is claimed is:

1. A method for monitoring the production of spun yarn in an open-end rotor spinning machine comprising the following steps:

(a) withdrawing the spun yarn from said open-end rotor spinning machine, (b) sensing changes in centrifugal force acting in said rotor upon the yarn being produced as a result of variations in the mass of yarn, (c) producing a reference signal representing the average mass of said yarn for a predetermined period of time, (d) producing an instantaneous signal indicating the instantaneous mass of said yarn being produced, and (e) comparing said instantaneous signal with said reference signal and generating an out of tolerance signal responsive to said instantaneous signal exceeding a predetermined difference from said reference signal.

2. The method as set forth in claim 1 wherein (a) said reference signal represents an upper threshold value for the yarn being produced, (b) producing a second reference signal which represents a lower threshold value for the yarn being produced, and (c) comparing said second reference signal with said instantaneous signal for determining when the mass of said yarn drops below a predetermined level.

3. The method as set forth in claim 1 further comprising:

using said out of tolerance signal for stopping said open-end rotor spinning machine.

4. The method as set forth in claim 1 wherein said reference signal varies according to the weight of yarn being produced.

5. An apparatus for monitoring the production of the yarn being produced on an open-end rotor spinning machine for detecting flaws in said yarn, said apparatus comprising:

(a) sensing means for sensing changes in centrifugal force acting in said rotor upon the yarn being produced as a result of variations in the mass of said yarn, (b) means coupled to said sensing means for producing a reference signal corresponding to the average mass of said yarn being produced over a predetermined period of time, (c) means for producing an instantaneous signal having a value corresponding to sudden changes in the mass of said yarn, and (d) means for comparing said reference signal with said instantaneous signal and producing an out of tolerance signal when the difference exceeds a predetermined value.

6. The apparatus as set forth in claim 5 further comprising:

(a) means for withdrawing said yarn from said open-end rotor spinning machine, (b) said sensing means including, (i) an arm over which said yarn passes as said yarn is withdrawn from said rotor for being displaced responsive to changes in mass of said yarn, and (ii) means for generating an electrical signal corresponding to the displacement of said arm.

7. The apparatus as set forth in claim 6 wherein said arm is spring loaded so as to be deflected in two mutually opposite directions essentially lateral to the longitudinal axis of said yarn passing thereover responsive higher or lower thread tension.

8. The apparatus as set forth in claim 6 wherein said means for generating an electrical signal corresponding to the displacement of said arm includes:

(a) a balanced bridge circuit;

(b) said bridge circuit having a pair of spaced coils, and (c) said arm being positioned between said spaced coils for causing said bridge circuit to generate an electrical signal corresponding in value to the displacement of said arm between said coils.

9. The apparatus as set forth in claim 5 wherein said means for producing said reference signal includes an integrator and said reference signal is an integrated signal.

10. The apparatus as set forth in claim 5 wherein said sensing means includes a bending spring member clamped at one end, said yarn being produced passing over said spring member for deflecting said spring member responsive to variations in the mass of said yarn, and means for generating an electrical signal responsive to deflection of said spring member.

11. An apparatus for monitoring the tension in yarn as said yarn is drawn off of a yarn processing machine, said apparatus comprising:

(a) movable means over which said yarn passes as said yarn is drawn off said yarn processing machine for being deflective responsive to changes in tension in said yarn, (b) means operably associated with said movable means for generating an electrical signal having an amplitude corresponding to the position of said movable means, (c) means for integrating said electrical signal producing an integrated electrical signal corresponding to changes in tension in said yarn over a predetermined period of time, (d) means receiving said electrical signal and generating an instantaneous signal having a value corresponding to sudden changes in the tension of said yarn, and (e) a comparator means comparing said integrated electrical signal with said instantaneous signal for generating an out of tolerance signal responsive to sudden changes in the tension in said yarn.

* * * * *